United States Patent [19]

Dederer et al.

[11] Patent Number: 4,912,444

[45] Date of Patent: Mar. 27, 1990

[54] SUPERCONDUCTING SOLENOID COIL STRUCTURE WITH INTERNAL CRYOGENIC COOLANT PASSAGES

[75] Inventors: Jeffrey T. Dederer, Penn Hills; Donald T. Hackworth, Monroeville, both of Pa.

[73] Assignee: Westinghouse Electric Corp., Pittsburgh, Pa.

[21] Appl. No.: 306,194

[22] Filed: Feb. 6, 1989

[51] Int. Cl.[4] ..... H01F 7/22

[52] U.S. Cl. ..... 335/216; 335/300

[58] Field of Search ..... 335/216, 299, 300; 174/15.4; 336/DIG. 1

[56] References Cited

U.S. PATENT DOCUMENTS

| | | | |
|---|---|---|---|
| 3,444,307 | 5/1969 | Kafka | 174/15.5 |
| 3,686,422 | 8/1972 | Doose | 174/15 |
| 3,801,942 | 4/1974 | Elsel | 335/216 |
| 3,869,686 | 3/1975 | Benz | 335/216 |
| 4,122,512 | 10/1978 | Peterson et al. | 363/14 |
| 4,418,325 | 11/1983 | Elsel | 335/216 |
| 4,421,946 | 12/1983 | Furuto et al. | 174/128 |
| 4,447,670 | 5/1984 | Eckels | 174/15 |
| 4,482,878 | 11/1984 | Burgeson et al. | 335/216 |
| 4,549,156 | 10/1985 | Mine et al. | 335/216 |
| 4,554,407 | 11/1985 | Ceresara et al. | 174/128 |
| 4,568,900 | 2/1986 | Agatsuma et al. | 335/216 |
| 4,622,531 | 11/1986 | Eyssa et al. | 335/216 |
| 4,652,697 | 3/1987 | Ando et al. | 174/128 |
| 4,665,611 | 5/1987 | Sadakata et al. | 29/599 |
| 4,687,883 | 8/1987 | Flükiger et al. | 174/126 |
| 4,692,560 | 9/1987 | Hotta et al. | 174/15 |
| 4,702,825 | 10/1987 | Selvaggi et al. | 209/224 |
| 4,739,202 | 4/1988 | Hatanaka et al. | 310/52 |
| 4,743,713 | 5/1988 | Scanlan | 174/128 |

FOREIGN PATENT DOCUMENTS

| | | |
|---|---|---|
| 2205413 | 8/1978 | Fed. Rep. of Germany . |
| 59-18689 | 1/1984 | Japan . |
| 2021881 | 5/1979 | United Kingdom . |

*Primary Examiner*—George Harris

[57] ABSTRACT

In a superconducting solenoid disposed in a cryogenic bath, the solenoid being in the form of a cylindrical annulus having a vertical axis and being composed of: two conductors (2,4) each containing superconductive material and each wound into a single layer helical coil; first and second support units (6) each supporting a respective conductor (2,4); and insulation members (8,12,14) composed of horizontal insulating layers (12) interposed between successive turns of each of the conductors (2,4), and vertical insulating layers (10) interposed between the first support unit (6) and the second support unit (6), the insulation members (8,12,14) being constructed such that variations in the current flowing through the conductors (2,4) produce varying magnetic fields which cause the insulation members (8,12,14) to experience heat-generating frictional movements, the support units (6) and the insulation members (8,12,14) are provided with a network of interconnected flow channels (22,24,26) communicating with the bath and in thermal communication with the vertical insulating layers (10) for creating a flow of cryogen from the bath and into thermal communication with the vertical insulating layers (10).

10 Claims, 2 Drawing Sheets

SUPERCONDUCTING SOLENOID COIL STRUCTURE WITH INTERNAL CRYOGENIC COOLANT PASSAGES

BACKGROUND OF THE INVENTION

The present invention relates to superconducting solenoid coils of the type which are maintained superconductive by being immersed in a cryogenic bath.

The unique electrical properties of superconductors have led to proposals for storing large quantities of electrical energy in large superconducting coils, one type of which would be an annular solenoid installed, possibly below ground, so that its axis is vertical. The proposed solenoids would have a substantial axial height and diameter, the diameter possibly being of the order of 500 to 1000 meters or more.

The superconductive materials which are currently usable in practice, such as NbTi, must be maintained at a temperature in the vicinity of 1°–4° K. in order to exhibit superconducting properties. Such temperatures can be established by surrounding the superconducting material with successive envelopes of cryogens having progressively higher boiling points.

For example, it is known to use, for this purpose, an envelope of helium, which can be made to have a boiling point lower than 4° K., surrounded by an envelope of neon, having a boiling point of in the vicinity of 28° K., the latter being surrounded by an envelope of nitrogen, having a boiling point in the vicinity of 77° K. Each of these cryogens is maintained in the liquid state by a suitable refrigeration system.

During operation of such a solenoid at superconducting temperatures, the varying magnetic fields generated during operation will cause adjacent layers of the solenoid structure, and particularly the layers of insulating material, to slide relative to one another, producing heat due to friction. Sufficient heat can be generated to produce local hot spots which can bring the conductor above its superconducting temperature. This will result in further heat generation which can cause the entire coil to cease to be superconducting.

SUMMARY OF THE INVENTION

It is an object of the present invention to protect the conductor of such a coil from the adverse effects of such local heating.

A more specific object of the invention is to bring cryogen into thermal communication with the regions where such heating occurs in order to efficiently remove the generated heat and prevent its transmission to the conductors.

The above and other objects are achieved, according to the present invention, in a superconducting solenoid disposed in a cryogenic bath, the solenoid being in the form of a cylindrical annulus having a vertical axis and being composed of: two conductors each containing superconductive material and each wound into a single layer helical coil; first and second support means each supporting a respective conductor; and insulation means composed of horizontal insulating layers interposed between successive turns of each of the conductors, and vertical insulating layers interposed between the first support means and the second support means, the insulation means being constructed such that variations in the current flowing through the conductors produce varying magnetic fields which cause the insulation means to experience heat-generating frictional movements, by providing the support means and the insulation means with a network of interconnected flow channels communicating with the bath and in thermal communication with the vertical insulating layers for creating a flow of cryogen from the bath and into thermal communication with the vertical insulating layers.

DESCRIPTION OF THE PREFERRED EMBODIMENTS

Figure 1:
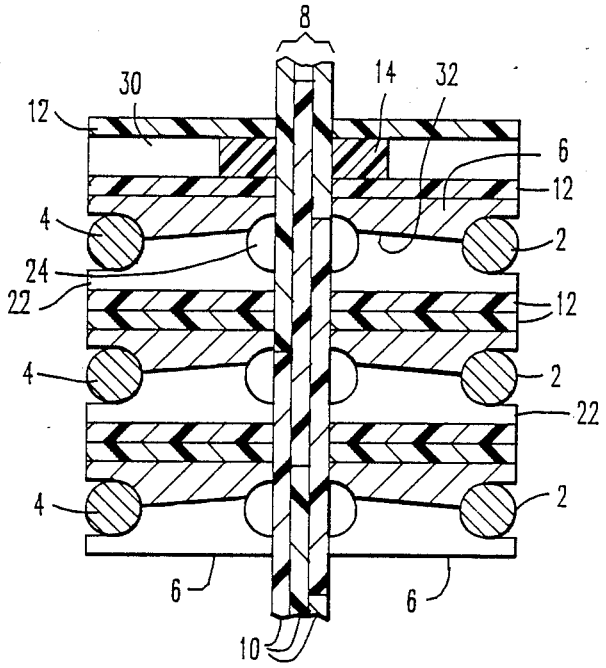
FIG. 1 is a cross-sectional detail view of a solenoid coil structure according to a preferred embodiment of the invention.

FIG. 1 illustrates, in cross section, several layers of a solenoid coil structure according to the present invention. Current is carried by conductor members 2 and 4 each of which is composed of a cylindrical stabilizer, for example of high purity aluminum, provided on its outer surface with a succession of helical grooves each containing a stranded conductor of superconductive material, such as NbTi. Conductor members 2 and 4 can be constructed in a manner which has already been proposed. Each conductor member 2 and 4 is wound in a plurality of vertically spaced turns to form two single layer helical windings, with the winding formed by conductor member 4 being disposed radially inwardly of the winding formed by conductor member 2. Conductors 2 and 4 can be connected at their ends to be either in series or in parallel.

Each conductor member 2, 4 is supported by a support structure composed of a succession of support bodies 6 disposed in abutting relation with one another along the length of the respective conductor member 2, 4. Each support body 6 can be a one-piece structure made of high purity structural aluminum and is provided at its exposed edge with a U-shaped groove in which the associated conductor member 2 or 4 is retained.

The coil structure further includes an insulating structure composed of an axially extending, cylindrical insulation unit 8 composed of a plurality of cylindrical insulating layers, or panels, 10. Insulation unit 8 provides electrical insulation between support bodies 6 for conductor member 2 and support bodies 6 for conductor member 4.

Between vertically spaced support bodies 6 there are disposed horizontal insulating layers, or panels, 12 and at regular intervals along the height of the coil there are disposed comparatively thick insulating panels 14.

The complete coil is made up of a large number of the components shown in FIG. 1 and the weight of the resulting coil structure is supported by the floor of a concrete lined, annular trench. The completed coil will be enclosed in a cryogenic cooling system which includes an annular vessel which encloses the coil and contains a helium bath. The vessel would typically be made of aluminum or stainless steel.

Figure 2:
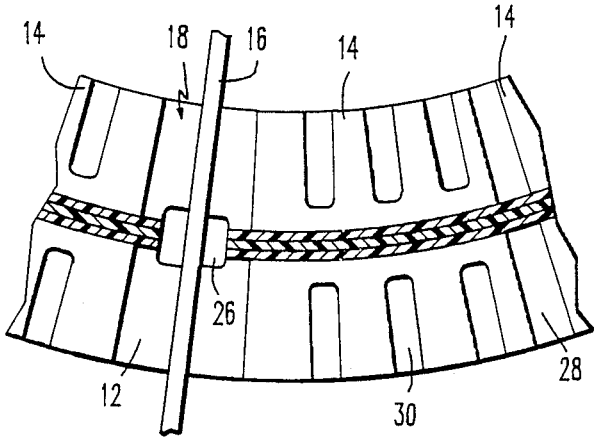
FIG. 2 is a detail plan view of the structure of FIG. 1.

As shown in FIG. 2, radial supports 16 are provided between the inner and outer walls of the vessel and each support 16 can extend through a radial passage 18 formed in a respective insulating panel 14. Each radial support 16 can be constituted by a solid rod of the same material as the helium vessel. Supports 16 would be prevented from contacting adjacent support bodies 6 by the insulating panels 12 disposed in contact with each insulating panel 14.

Reverting to FIG. 1, each of insulating panels 10, 12 and 14 can be made of a suitable electrical insulating material, such as an epoxy-glass compound of the type sold under the trade designation "G10". Each of those panels can have a thickness of the order of 0.6–1.6 mm.

After the coil structure of the type illustrated in FIG. 1 has been assembled at room temperature, cooling to cryogenic temperatures produces stresses which take the form of tensile stresses in the radially outer portion of each component and compressive stresses in the radially inner portion of each component. The varying magnetic fields produced by the coils during operation have radial components which produce bending moments that can cause adjacent layers, particularly the layers defined by insulating panels 10 to slide relative to one another. These movements, together with the normal force between layers, can produce frictional heating at the interfaces between panels. In addition, the radial pressures existing in the solenoid vary axially and can cause relative movements between horizontal interfaces, for example between the mating surfaces of the insulating panels 12 which are adjacent one another. These frictional movements are also converted to heat which must be removed from the vicinity of the superconductors by the surrounding cryogenic bath. Frictional movements can also occur between conductor members 2,4 and support bodies 6.

There is very little margin for temperature variations below the value at which superconductivity is established. A local hot spot could create a locally high resistance which in turn produces further heat generation. Thus, the possibility exists for a local temperature increase which will cause the entire coil to cease to be superconducting.

According to the present invention, such frictionally generated heat is effectively removed by the provision of a network of cryogen flow channels which bring the cryogen into thermal communication with the regions where this heat is generated.

According to one preferred embodiment of the invention, the network of flow channels is constituted by radial flow channels 22 which extend across each support body 6 from the cryogen bath to a region adjacent vertical insulation unit 8. The network further includes circumferential flow channels 24 located on either side of insulating unit 8 and communicating with channels 22. Circumferential flow channels 24 can follow a helical path, parallel to conductors 2,4, along each side of insulation unit 8.

The network is completed by vertical, or axial manifolds 26, shown in FIG. 2, which are defined by openings in support bodies 6 and discontinuities in insulation unit 8. Thus, manifolds 26 establish flow communication between flow channels 24 on both sides of insulation unit 8 and communicate with the cryogen bath via passages 18. To further aid efficient flow of the cryogen, insulating panels 14 are spaced apart circumferentially and insulation unit 8 is provided with radial openings to define radial flow channels 28 which extend across the entire radial width of the solenoid structure.

Additionally, each insulating panel 14 is provided, along each edge, with an array of recesses 30 which provide further communication between the cryogen and the regions surrounding conductors 2 and 4.

Figure 3:
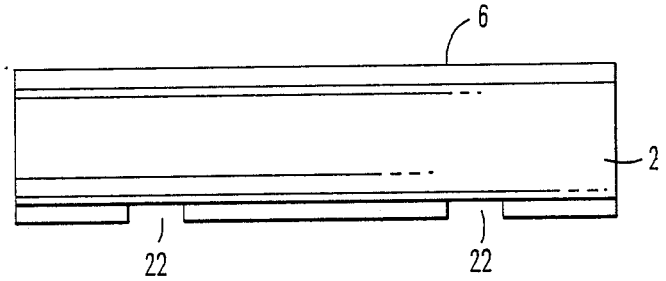
FIG. 3 is a front elevational view of one component of the structure of FIGS. 1 and 2.

Flow channels 22 are spaced apart around the circumference of the solenoid structure, as shown in FIG. 3 for one support body 6. As further shown in FIG. 1, each radial flow channel 22 has a curved inlet portion which passes beneath an associated conductor 2, 4, followed by an essentially straight portion having a top wall 32 which is inclined upwardly toward the associated channel 24 to encourage vapor release from heated areas through a natural buoyancy driven process. The void left by such vapor would then be filled with more cryogen from the bath. The various radial passages not only enhance cooling, but allow for rapid removal of cryogen from the internal passages in the solenoid if it should be necessary to remove all cryogen from the system, as would occur in the event of a solenoid malfunction, or if the solenoid should cease to be superconducting, or if the unit must be taken out of service for maintenance.

All radial passages are preferably placed at areas where the bending moments, and hence the normal stresses, on the solenoid structure, would be at a minimum so as to allow for the fact that these passages would be the site of stress concentrations.

Channels 24 are located directly adjacent insulation unit 8 and thus bring the cryogen to a location for effectively removing frictionally generated heat therefrom. By forming channels 24 to follow a helical path, the flow of cryogen is promoted and bubbles of vaporized cryogen are prevented from being trapped.

As is best shown in FIG. 3, channels 22 can have a rectangular cross section, while channels 24 and 26 can have the cross sections shown in FIGS. 1 and 2. Of course, other cross-sectional configurations are possible.

Thus, the present invention allows the cryogen to be brought into those areas where heat is most likely to be generated by frictional movements. However, particularly as can be appreciated from a consideration of FIG. 3, adequate conductor support is retained to accommodate the radial magnetic loads induced in conductors 2 and 4. In addition, the bearing loads on the insulating components can be maintained well within the design range for the materials employed.

The channel network and recesses 30 according to the invention will expose more of the solenoid structure directly to the cryogen bath and thus promote a more rapid and uniform initial cooling to superconducting temperature.

In the illustrated embodiment, insulation unit 8 extends vertically over the entire height of the solenoid and insulating panels 12 and 14 are disposed to each side of unit 8. According to an alternative embodiment of the invention, insulating panels 14 can be unitary members which extend across the entire radial dimension of the solenoid structure and insulating unit 8 could be vertically divided into sections, with each section extending between two successive insulating panels 14.

Figure 4:
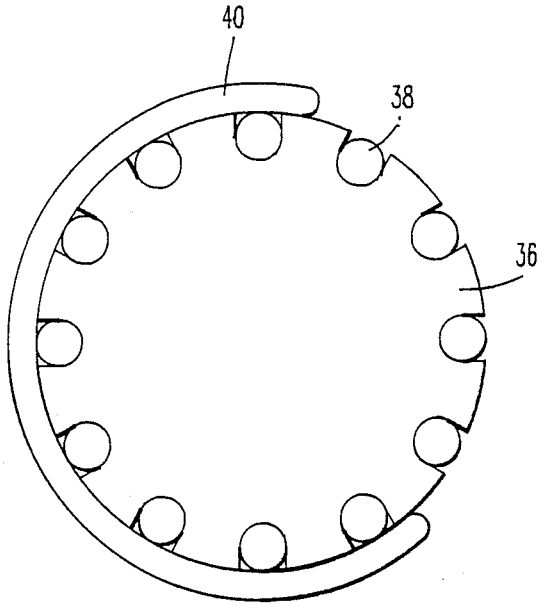
FIG. 4 is an end view of one suitable type of conductor member which can be employed in a coil structure according to the invention.

FIG. 4 shows one suitable embodiment of conductors 2, 4, of a type which has been previously proposed. As illustrated, each conductor can be constituted by an aluminum stabilizer 36 in the form of a solid rod having a plurality of helical channels of circular cross section milled in its periphery. Each channel carries a superconducting strand 38 which is formed by twisting together a large number of filaments of a material such as NbTi, each filament possibly having a diameter of the order of 20 microns. Stabilizer 36 is enclosed by a C-section conductor support 40.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. In a superconducting solenoid disposed in a cryogenic bath, the solenoid being in the form of a cylindrical annulus having a vertical axis and being composed of:

two conductors each containing superconductive material and each wound into a single layer helical coil;

first and second support means each supporting a respective conductor; and insulation means composed of horizontal insulating layers interposed between successive turns of each of the conductors, and vertical insulating layers interposed between the first support means and the second support means, the insulation means being constructed such that variations in the current flowing through the conductors produce varying magnetic fields which cause the insulation means to experience heat-generating frictional movements, the improvement wherein said support means and said insulation means are provided with a network of interconnected flow channels communicating with the bath and in thermal communication with said vertical insulating layers for creating a flow of cryogen from the bath and into thermal communication with said vertical insulating layers.

2. An arrangement as defined in claim 1 wherein each said support means comprises a plurality of support bodies disposed adjacent one another along the length of the respective conductor, each said support body having a vertical outer edge contacting the bath, a vertical inner edge contacting one of said vertical insulating layers, and a groove extending from said outer edge, with the respective conductor being supported in said groove, and wherein said network of channels comprises a plurality of first channels each formed in a respective support body and extending from said outer edge of said respective support body in the direction of said inner edge of said respective support body.

3. An arrangement as defined in claim 2 wherein each said first channel has an inlet portion extending, and inclined upwardly, from said outer edge of its respective support body, and located below the conductor supported by said respective support body.

4. An arrangement as defined in claim 2 wherein said network of channels further comprises two second channels each formed in said support bodies of a respective one of support means, at said inner edges of said support bodies, each said second channel being in flow communication with said vertical insulating layers which are in communication with said support bodies of the respective support means and with said first channels formed in said support bodies of the respective support means, and extending parallel to said conductor which is supported by the respective support means.

5. An arrangement as defined in claim 4 wherein each said first channel has an inlet portion extending, and inclined upwardly, from said outer edge of its respective support body, and located below the conductor supported by said respective support body

6. An arrangement as defined in claim 5 wherein each said first channel further has an outlet portion extending from its said inlet portion to a respective one of said second channels and having a top wall which is inclined upwardly from said inlet portion to said respective one of said second channels.

7. An arrangement as defined in claim 4 wherein said network of channels further comprises a plurality of vertically extending manifold channels spaced apart around the circumference of said solenoid and each in flow communication with both of said second channels.

8. An arrangement as defined in claim 8 wherein said manifold channels are defined in part by vertical discontinuities in said vertical insulating layers.

9. An arrangement as defined in claim 1 wherein: said insulation means further comprise horizontal insulating bodies which are thicker than said horizontal insulating layers; each said insulating body has one edge in contact with the bath; and each said insulating body is provided with a plurality of recesses extending from said one edge for containing a quantity of cryogen.

10. An arrangement as defined in claim 9 wherein each of said insulating bodies and said vertical insulating layers are formed to present radial cryogen flow passages which extend between opposed circumferential boundaries of the solenoid.

* * * * *